United States Patent [19]

Teck et al.

[11] Patent Number: 4,943,244

[45] Date of Patent: Jul. 24, 1990

[54] GROUNDING ELECTRICAL CONNECTOR

[75] Inventors: Yap Y. Teck; Lim T. Wah; Anna T. K. Geok; Chan H. Weng, all of Singapore, Singapore

[73] Assignee: Molex Incorporated, Lisle, Ill.

[21] Appl. No.: 456,765

[22] Filed: Dec. 26, 1989

[51] Int. Cl.[5] ..... H01R 13/73

[52] U.S. Cl. ..... 439/567; 439/571; 439/607

[58] Field of Search ..... 439/92, 101, 108, 607, 439/567, 554, 569, 570, 571, 82–84, 562, 563

[56] References Cited

U.S. PATENT DOCUMENTS

| | | | |
|---|---|---|---|
| 4,506,937 | 3/1985 | Cosmos et al. | 439/101 |
| 4,512,618 | 4/1985 | Kumar | 439/607 |
| 4,521,062 | 6/1985 | Kurbikoff et al. | 439/101 |
| 4,639,066 | 1/1987 | Shimaniya et al. | 439/83 |
| 4,679,883 | 7/1987 | Assini et al. | 439/83 |
| 4,709,973 | 12/1987 | Waters et al. | 439/82 |
| 4,717,219 | 1/1988 | Frantz et al. | 439/82 |
| 4,795,353 | 1/1989 | Baker | 439/82 |
| 4,824,398 | 4/1989 | Taylor | 439/83 |
| 4,842,552 | 6/1989 | Frantz | 439/82 |
| 4,865,555 | 9/1989 | Assini et al. | 439/82 |
| 4,874,336 | 10/1989 | Marsh | 439/607 |
| 4,889,502 | 12/1989 | Althouse et al. | 439/83 |

*Primary Examiner*—Gary F. Paumen

*Attorney, Agent, or Firm*—Louis A. Hecht; Stephen Z. Weiss

[57] ABSTRACT

An electrical connector for mounting to a substrate such as a printed circuit board includes an insulative housing. The housing defines a front face, a rear portion and a bottom portion which is mountable to the printed circuit board. A conductive shield is positionable against the front face of the housing and includes a ground strap extending rearwardly beneath the base portion of the housing. A conductive board lock member is positionable against the rear portion of the housing and includes a commoning portion extending forwardly beneath the base portion of the housing in engagement with the ground strap of the conductive shield. The board lock member has legs positionable through a locking hole in the printed circuit board and for commoning the shield to a ground trace on the printed circuit board adjacent the hole.

19 Claims, 4 Drawing Sheets

GROUNDING ELECTRICAL CONNECTOR

FIELD OF THE INVENTION

This invention generally relates to electrical connectors and, particularly, to an electrical connector mountable to a substrate such as a printed circuit board for grounding and locking thereto.

BACKGROUND OF THE INVENTION

In the electronics industry, electrical connectors are mounted to printed circuit boards, such as by right angled mounting, for electrical connection to circuit traces on the boards. Typically, the electrical connectors are imprinted onto the printed circuit boards by automated methods, and the electrical connections are wave soldered to the circuits on the boards. The connectors usually include some form of locking or retention feature to hold the connectors to the boards and, in addition, the connectors include a commoning feature to ground a shield or other component of the connector to a ground trace on the board, often by insertion of a commoning element through a hole of the printed circuit board.

One type of electrical connector of the character described above is known in the electrical connector industry as a miniature or sub-miniature D connector. The connector includes a plug and a receptacle, each having an insulative housing containing a plurality of mating terminals or contacts. In order to shield against RF/EM interference, an exterior metal or conductive shell typically encloses the housings. The shielding shells are effectively grounded to the ground traces on the printed circuit board.

One of the main problems in utilizing such miniature connectors in conjunction with printed circuit boards is the cost of assembling the connectors themselves which is done prior to assembling the connectors to the printed circuit boards. Often, extraneous locking hardware, such as bolts, posts and rivets are used both to assemble the connectors and ready the connectors for interconnection to the boards. Although automated processes are being used to interconnect the connectors to the printed circuit boards, automated processes for assembling the connectors themselves have been difficult because of the nature of the miniature connector construction in combination with the extraneous hardware used in the connector assembly. Often, the connector components are assembled in directions on given axes, such as assembling the shielding shell to the housing in one direction on a given axis, and the extraneous hardware is assembled in different directions on other axes, requiring multiple steps and/or at different assembly stations in the assembly process.

This invention is directed to solving the above problems and providing a new and improved electrical connector adapted for mounting on a printed circuit board, which substantially entirely eliminates extraneous assembly, locking and mounting hardware and which is readily adaptable for automated assembly processes.

SUMMARY OF THE INVENTION

An object, therefore, of the invention is to provide a new electrical connector for mounting to a substrate such as a printed circuit board.

Generally, the electrical connector includes an insulative housing, a conductive shield and a conductive board lock member. These three components, alone, substantially entirely make up the connector for assembly to the printed circuit board. The conductive shield is assembled to a front portion of the housing in a given direction on a given axis, and the conductive board lock member is assembled to a rear of the housing on the same axis but opposite the direction of assembling of the shield. As the shield and board lock member are assembled to the housing, the board lock member automatically locks to the housing and establishes a commoning ground to the shield, all without extraneous hardware. This singular directional assembly approach is readily adaptable for easy automated assembly. The board lock member has integral leg means for positioning through a locking hole in the printed circuit board and for commoning the shield to a ground trace on the board, again without requiring any extraneous hardware whatsoever.

In the exemplary embodiment of the invention, the housing has a peripheral flange defining a front face, and a base portion which is mountable to the printed circuit board and defining a rear flange. The conductive shield is positionable against the front face of the housing, is locked over the peripheral flange and includes a ground strap extending rearwardly beneath the base portion of the housing. The conductive board lock member is generally U-shaped for positioning over the rear flange of the housing. A top leg of the U-shape has a spring locking tab for snap-fitting into a recess on top of the housing and a bottom leg for engaging the ground strap of the shield. The bottom leg also has integral leg means for insertion through the locking hole in the printed circuit board.

It can be seen from the above description that the conductive shield and the conductive board lock member are assembled to the insulative housing in opposite directions but on a single axis for easy automated assembly, and the cooperative integral features of the shield and the board lock member lock the assembly together, lock the assembly to the printed circuit board and ground the shield to the board ground traces.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

BRIEF DESCRIPTION OF THE PREFERRED EMBODIMENT

Figure 1:
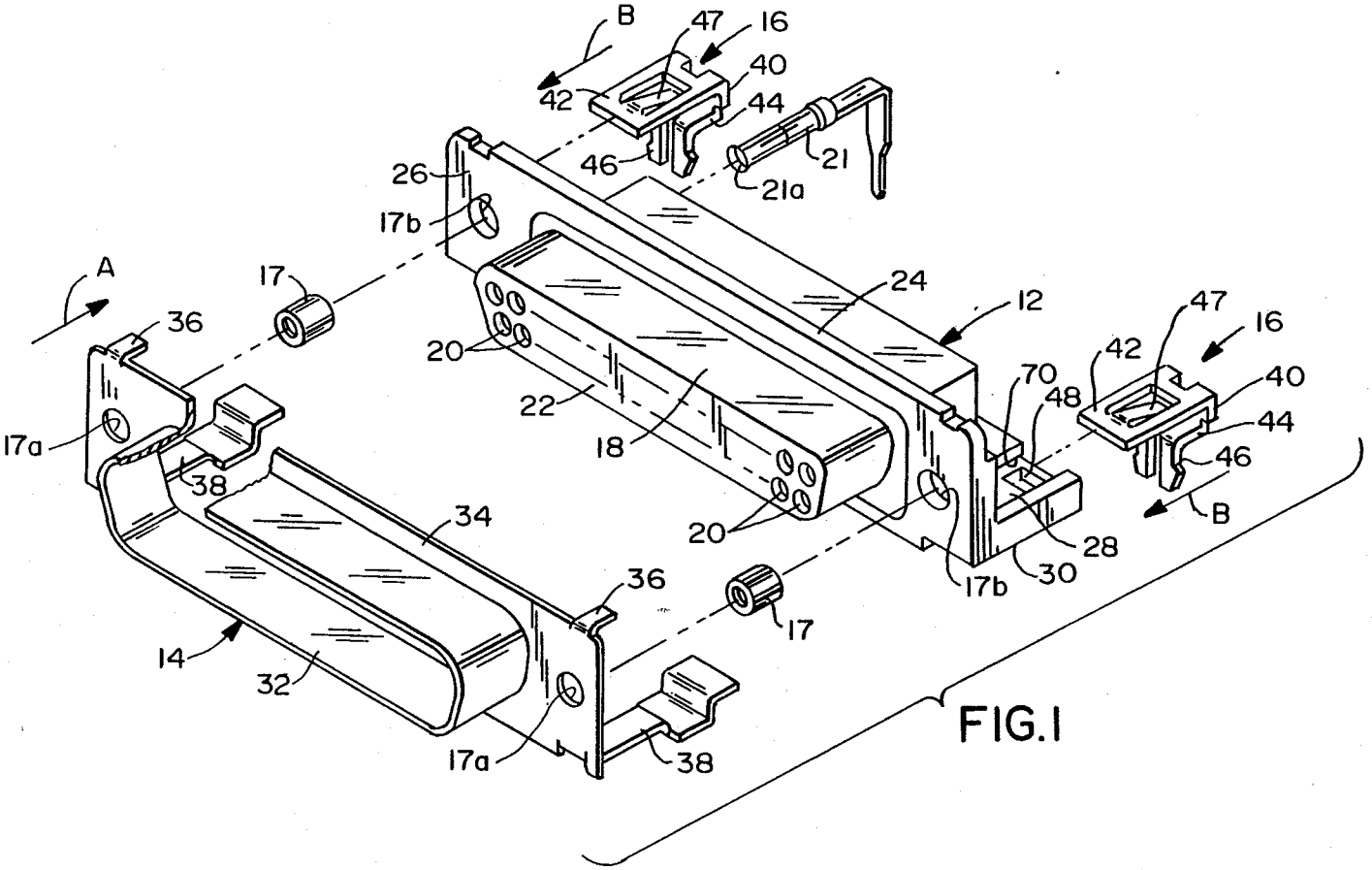
FIG. 1 is an exploded perspective view of the components of an electrical connector embodying the concepts of the invention.

Referring to the drawings in greater detail and first to FIG. 1, the invention is illustrated as embodied in a miniature or sub-miniature D connector, generally designated 10 and shown in exploded condition The connector includes a unitary insulative housing, generally designated 12, a conductive shield, generally designated 14, and a pair of conductive board lock members, generally designated 16. In addition to the terminals, as will be understood hereinafter, these four major components substantially entirely comprise the electrical connector for shielding purposes, grounding purposes and for purposes of locking the connector to a printed circuit board without any other extraneous hardware.

As further will be understood hereinafter, conductive shield 14 is assembled to insulative housing 10 in the direction of arrow "A", and conductive board lock members 16 are assembled to the housing in the direction of arrow "B" which is directly opposite the direction of arrow "A". Therefore, automated assembly is very easily afforded. In addition, once so assembled, board lock members 16 automatically lock to housing 12 and automatically establish a commoning ground with shield 14. Taking into consideration that appropriate electrical terminals are inserted into housing 12 in the same "direction" as arrows "A" and "B", as is known in assembling such subminiature D connectors, the entire connector assembly can be completely assembled in an automated fashion. For mounting or fixing the connector to a mating connector, mounting screw inserts 17 are fixed within apertures **17*a* in conductive shield 14 and apertures 17*b* in housing 12**.

Insulative housing 12 includes a D-shaped body portion 18 defining a plurality of terminal passages 20 for receiving appropriate electrical terminals 21 with a mating portion **21*a* of each terminal directed toward a mating face 22 of the body. A peripheral flange 24 surrounds body 18 and defines a front face 26 A base portion 28 defines a rear flange projecting rearwardly from peripheral flange 26 and includes a bottom face 30 for mounting onto a printed circuit board Conductive shield 14 has a shroud portion 32 and an integral peripheral flange 34. When assembled, shroud 32 surrounds body portion 18 of housing 12 and peripheral flange 34 abuts against front face 26 of peripheral flange 24 of the housing Integral retaining tabs 36 project rearwardly from the top edge of peripheral flange 34 for crimpingly engaging the top edge of peripheral flange 24 of the housing Lastly, as described in greater detail hereinafter, a pair of integral ground straps 38 project rearwardly from the bottom edge of peripheral flange 34 beneath base portion 28 of the housing for underlying bottom face 30 thereof. The conductive shield is a stamped and formed, deep drawn metal member. A stamping and forming process is used to produce integral ground straps 38 and retaining tabs 36. Shroud 32** is produced through a deep draw process.

Each conductive board lock member 16 is generally U-shaped and includes a bight portion 40, an upper leg 42 and a bifurcated bottom leg 44. Board locking legs 46 project downwardly at right-angles to bottom leg 44 for insertion into a hole in a printed circuit board A spring locking tab 49 is formed out of top leg 42 for snap-fitting into a recess 48 on the top of base portion 28 of insulative housing 12. This entire conductive board lock member 16 is a stamped and formed metal member.

Referring to FIGS. 2–5 in conjunction with FIG. 1, the manner in which conductive shield 14 and conductive board lock members 16 are assembled to insulative housing 12 is clearly shown. During assembly, shield 14 is moved relative to housing 12 in the direction of arrow "A" (FIG. 2) until peripheral flange 34 abuts against front face 26 of peripheral flange 24 of the housing. When so positioned, ground straps 38 underlie bottom face 30 of base portion 28 which defines the rearwardly projecting flange of the housing. Also during assembly, an appropriate camming means on the assembly fixture crimps retaining tabs 36 over the top of peripheral flange 24 of the housing.

Conductive board lock members 16 are assembled to housing 12 in the direction of arrow "B", i.e., directly opposite the direction of arrow "A", whereby the U-shaped configuration of each member embraces base portion or rear flange 28 of the housing, and bight portion 40 of the board lock member abuts against the rear edge of the rear flange. It can be seen that upper leg 42 of each board lock member is juxtaposed on top of the rear flange and bifurcated lower leg 44 engages the underside of ground strap 38, as at 50, to provide commoning ground therewith.

Figure 2:
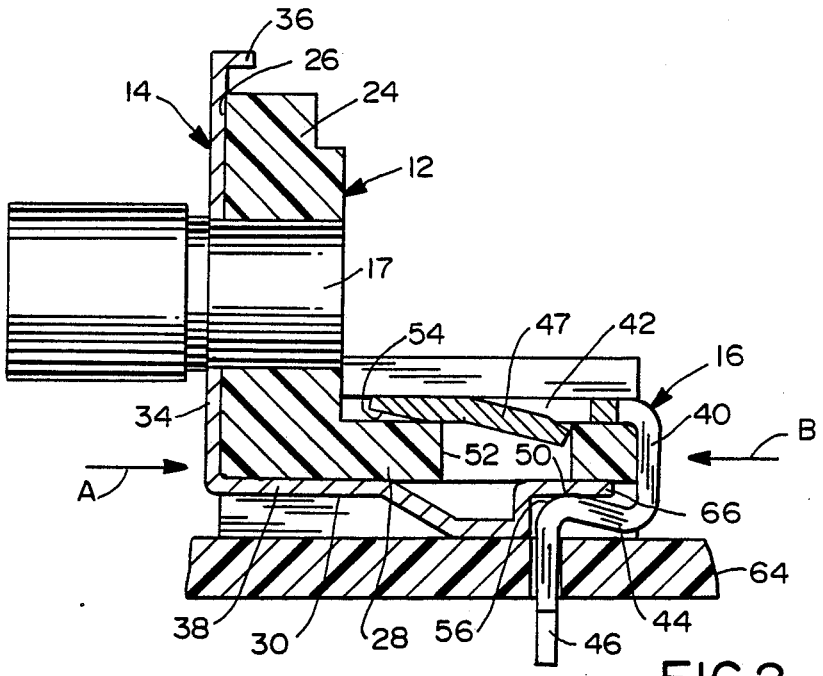
FIG. 2 is a vertical section through the connector in assembled condition.

The top surface of rear flange 28 of the housing has a recess 52. Locking tab 47 is stamped and formed out of board lock member 16 so as to be self-spring loaded to yield during assembly and then to snap-fit into recess 52 as shown in FIG. 2. The board lock member therefore is automatically locked into assembled position onto insulative housing 12 as a function of the assembly operation, embracing rear flange 28 of the housing and maintaining the board lock member grounded to conductive shield 14, as at 50. To this end, the distance between upper leg 42 and bifurcated lower leg 44 of the board lock member should be slightly less than the thickness of rear flange 28. Assembly is facilitated by flaring the underside of top leg 42 at the distal end thereof, as at 54, and providing a general curve at the juncture of bottom bifurcated leg 44 and locking legs 46, as at 56. This facilitates easy assembly so that the U-shaped board lock member not only embraces rear flange 28 of the housing but securely grips the rear flange and maintains a solid ground with ground strap 38 of the conductive shield.

Figure 3:
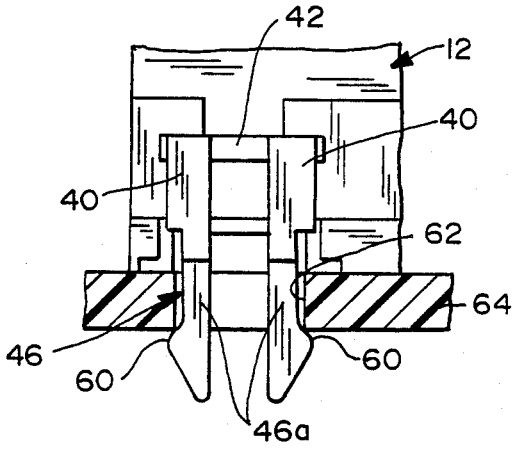
FIG. 3 is a fragmented elevational view looking toward the rear of the connector, or the right-hand portion as viewed in FIG. 2.

FIG. 3 shows that bifurcated leg 46 (referenced generally in that Figure) actually comprises two spaced leg portions **46*a* separated by a slot 58 so that the legs are self-spring loadable when biased toward each other. A board locking feature is provided by beveled rounded portions 60 which project outwardly from legs 46*a* so that when the legs are forced into a through hole 62 in a printed circuit board 64, the legs will yield toward each other to allow insertion and then return outwardly whereby rounded projecting portions 60** snap into locking engagement beneath the underside of the printed circuit board.

Figure 4:
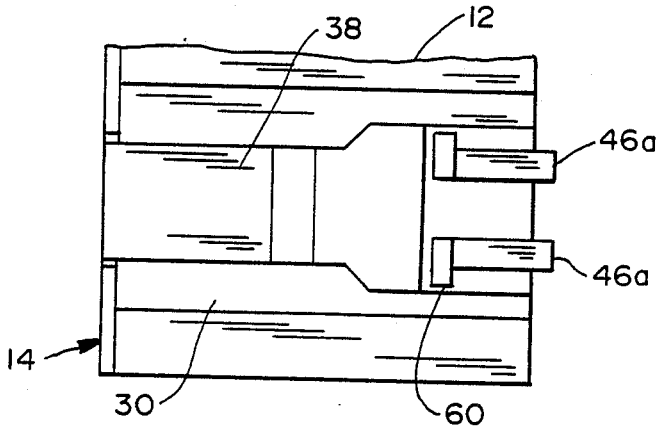
FIG. 4 is a fragmented bottom plan view of the connector illustrating the assembly of the board lock member.
Figure 6:
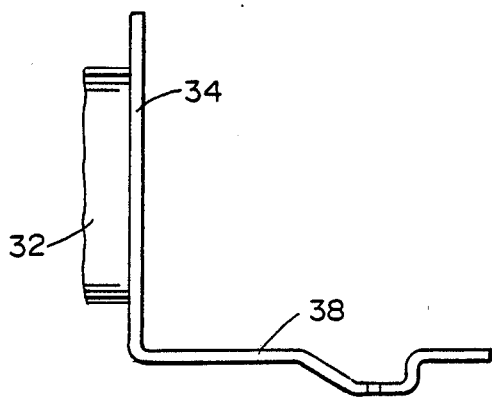
FIG. 6 is an end elevational view of the conductive shield component of the connector.
Figure 7:
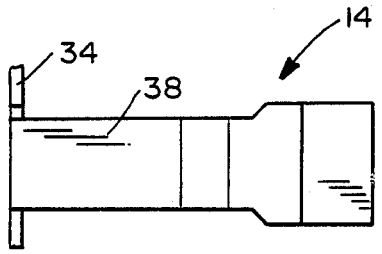
FIG. 7 is a bottom plan view of the ground strap portion of the conductive shield.

Referring to FIGS. 6 and 7 in conjunction with FIG. 4, it can be seen that each ground strap 38 of conductive shield 14 is formed on its distal end with a stepped configuration to define an upper portion 66 generally in the plane of the ground strap, and a lower portion 68. This construction allows for bifurcated legs 44 (FIG. 2) of each board lock member 16 to establish grounding engagement with the underside of upper portion 66 of the respective ground strap, as described in relation to FIG. 2.

Figure 5:
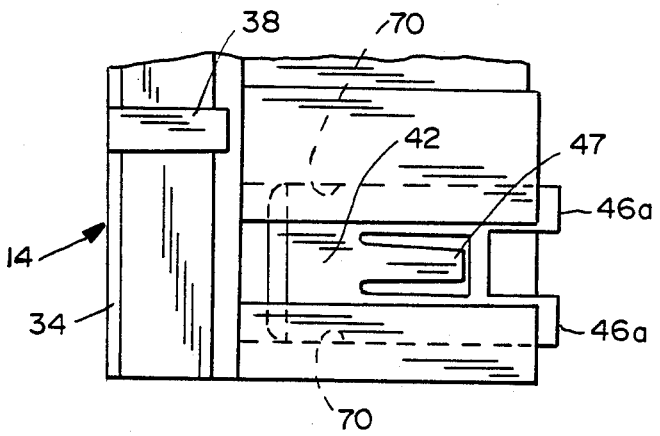
FIG. 5 is a fragmented top plan view opposite that of FIG. 4.
Figure 8:
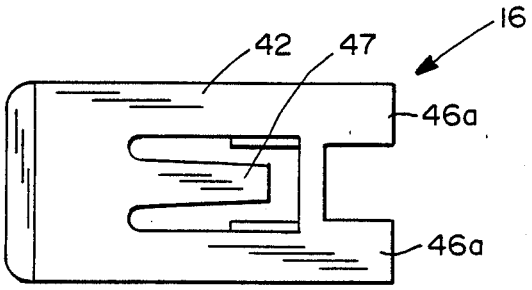
FIG. 8 is a top plan view of the conductive board lock member of the connector.

Lastly, FIGS. 5 and 8 show the construction of top leg 42 of each U-shaped board lock member 16 and illustrate how locking tab 46 is stamped and formed out of the unitary member to provide a self-spring loaded locking feature. It can be seen in FIG. 5 that leg 42 actually is positioned under ledges 70 along the sides of recess 28 of the housing (also see the right-hand end of the housing in FIG. 1).

From the foregoing, it can be seen that conductive ground shield 14 is assembled to insulative housing 12; conductive board lock members 16 are assembled to the housing; the board lock members are automatically locked to the housing; the board lock members establish a commoning ground with the ground straps of the conductive shield; the locking legs of the board lock members are positioned for insertion into a printed circuit board; and the appropriate terminals can be assembled into housing 12 all on a singular axis, although in opposite directions, as defined by arrows "A" and "B". It is readily apparent that this entire sequence of assembly operations or functions can be performed by a very simple automated process. No extraneous hardware is required and no assembly operations in other directions, such as perpendicular or oblique to arrows "A" and "B" are required which would necessitate additional assembly fixtures and/or stations.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein

We claim:

1. An electrical connector for mounting to a substrate such as a printed circuit board, comprising:

an insulative housing defining a front face, a rear portion and a base portion which is mountable to the printed circuit board;

a conductive shield positionable against the front face of the housing and including a ground strap extending rearwardly beneath the base portion of the housing; and a conductive board lock member positionable against the rear portion of the housing and including a commoning portion extending forwardly beneath the base portion of the housing in engagement with the ground strap of the conductive shield, the board lock member including leg means positionable through a locking hole in the printed circuit board and for commoning the conductive shield to a ground trace on the printed circuit board adjacent the hole.

2. The electrical connector of claim 1, including complementarily interengaging locking means between the conductive shield and the insulative housing.

3. The electrical connector of claim 2 wherein said front face of the insulative housing is defined by a peripheral flange, and said complementarily interengaging locking means include retaining tab means on the shield positionable about the flange.

4. The electrical connector of claim 3 wherein said retaining tab means of the shield are located for locking over a top of the flange, and the commoning portion of the board lock member is positionable over a bottom of the ground strap of the shield.

5. The electrical connector of claim 3 wherein said conductive shield comprises a stamped, formed and drawn member.

6. The electrical connector of claim 1, including complementarily interengaging locking means between the conductive board lock member and the insulative housing.

7. The electrical connector of claim 6 wherein said insulative housing has recess means, and said complementarily interengaging locking means include locking tab means on the board lock member snap-fit into the recess means.

8. The electrical connector of claim 7 wherein said recess means are formed in a top surface of the housing.

9. The electrical connector of claim 1 wherein said rear portion of the insulative housing comprises a rear flange, and said conductive board lock member is generally U-shaped for positioning over the rear flange, with said leg means depending from a bottom leg of the generally U-shape.

10. The electrical connector of claim 9, including recess means in a top surface of the rear flange of the housing, and locking tab means on a top leg of the generally U-shaped board lock member for snap-fitting into the recess means.

11. The electrical connector of claim 1 wherein said conductive board lock member comprises a stamped and formed member.

12. An electrical connector for mounting to a substrate such as a printed circuit board, comprising:

an insulative housing including a peripheral flange defining a front face and a rear flange defining a base portion which is mountable to the printed circuit board;

a conductive shield positionable against the front face of the housing and including a ground strap extending rearwardly beneath the base portion of the housing, and complementarily interengaging locking means between the conductive shield and the peripheral flange of the housing; and a generally U-shaped board lock member positionable over the rear flange of the housing, and including a bottom leg of the generally U-shape extending forwardly beneath the base portion of the housing in engagement with the ground strap of the conductive shield, and leg means depending from the bottom leg for positioning through a locking hole in the printed circuit board to common the shield to a ground trace on the printed circuit board adjacent the hole.

13. The electrical connector of claim 12, including recess means in a top surface of the rear flange of the housing, and locking tab means on a top leg of the generally U-shaped board lock member for snap-fitting into the recess means.

14. The electrical connector of claim 12 wherein said complementarily interengaging locking means include retaining tab means on the conductive shield for crimping over a top of the peripheral flange of the housing.

15. The electrical connector of claim 14, including recess means in a top surface of the rear flange of the housing, and locking tab means on a top leg of the generally U-shaped board lock member for snap-fitting into the recess means.

16. The electrical connector of claim 12 wherein said conductive shield comprises a stamped, formed and drawn member, and said conductive board lock member comprises a stamped and formed member.

17. An electrical connector for mounting to a substrate such as a printed circuit board, comprising an insulative housing having a front portion, a rear portion and a bottom face which is mountable to the printed circuit board, a conductive shield positionable against the front portion of the insulative housing in a first direction, a conductive board lock member positionable against the rear portion of the housing in a direction opposite said first direction, the conductive shield and the conductive board lock member being in engagement with each other when assembled to the housing, means on one of the conductive shield and conductive board lock member for establishing a commoning ground to a ground trace on the printed circuit board, and means on the board lock member for locking the assembled connector to the printed circuit board.

18. The electrical connector of claim 17 wherein said engagement between the conductive shield and the conductive board lock member are established by a ground strap of the conductive shield extending rearwardly beneath the bottom face of the housing and an overlapping commoning portion of the conductive board lock member extending forwardly beneath the bottom face of the housing.

19. A method of assembling an electrical connector for mounting to a substrate such as a printed circuit board, comprising the steps of:

providing an insulative housing defining a front face and a rear portion;

providing a conductive shield including a lower ground strap projecting rearwardly therefrom;

assembling the conductive shield against the front face of the housing such that the ground strap extends rearwardly beneath the housing;

providing a conductive board lock member with a lower commoning portion;

positioning the conductive board lock member against the rear portion of the housing with the commoning portion extending forwardly beneath the housing in engagement with the ground strap of the conductive shield; and locking at least one of the conductive shield and the conductive board lock member to the housing.

* * * * *